United States Patent [19]

Griffiths

[11] 4,171,125

[45] Oct. 16, 1979

[54] SPRING PANEL FOR SEAT CUSHION SUPPORT STRUCTURE

[75] Inventor: David T. Griffiths, Ammanford, Wales

[73] Assignee: Youngflex S.A., Fribourg, Switzerland

[21] Appl. No.: 883,191

[22] Filed: Mar. 3, 1978

[30] Foreign Application Priority Data

Apr. 4, 1977 [GB] United Kingdom ..... 14192/77
Jul. 19, 1977 [GB] United Kingdom ..... 30343/77

[51] Int. Cl.[2] ..... F16F 3/02

[52] U.S. Cl. ..... 267/102; 267/112; 267/142

[58] Field of Search ..... 267/80, 87, 96, 99, 267/102, 107, 108, 109, 112, 131, 133, 142, 144

[56] References Cited

U.S. PATENT DOCUMENTS

| | | | |
|---|---|---|---|
| 3,639,002 | 2/1972 | Tischler | 5/354 X |
| 3,797,886 | 3/1974 | Griffiths . | |
| 3,880,467 | 4/1975 | Tischler | 297/452 |
| 3,982,737 | 9/1976 | Platt et al. | 267/102 |
| 4,050,738 | 9/1977 | Griffiths . | |

FOREIGN PATENT DOCUMENTS 1193065 5/1970 United Kingdom .

*Primary Examiner*—George E. A. Halvosa
*Attorney, Agent, or Firm*—Berman, Aisenberg & Platt

[57] ABSTRACT

In a seat support structure of the kind comprising two spaced longitudinally extending cord members, and a plurality of spaced apart spring metal wires extending transversely between the longitudinal cords and connected to the latter, the transverse wires extending beyond at least one of the longitudinal cords into connection with an edge wire to define an angled, sprung wing of the structure, there is provided an improved, interlocking connection between the transverse wires and the or each longitudinal cord adjacent the wing to prevent failure of the connection under tension on the longitudinal cord.

3 Claims, 13 Drawing Figures

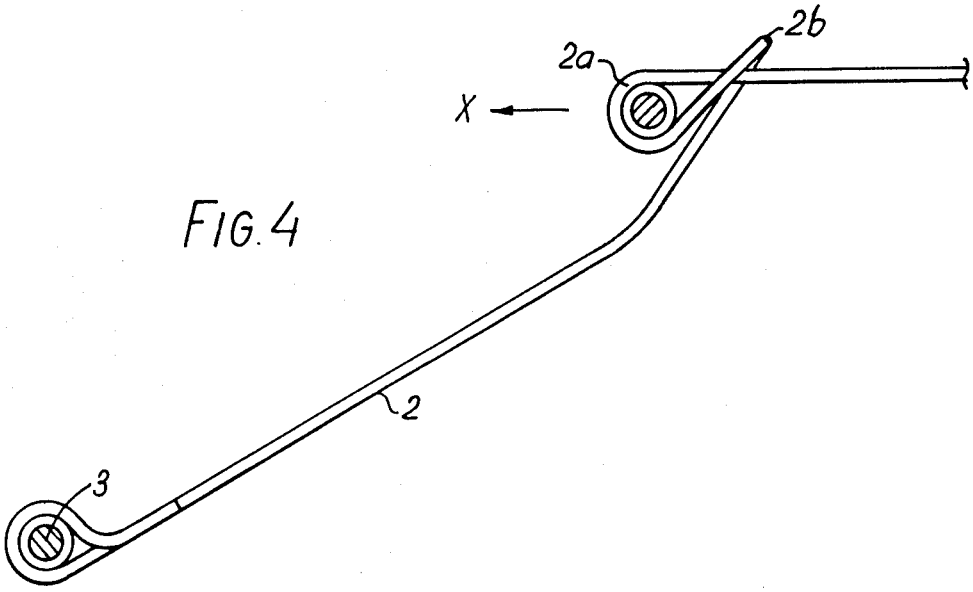
FIG. 4
FIG. 5
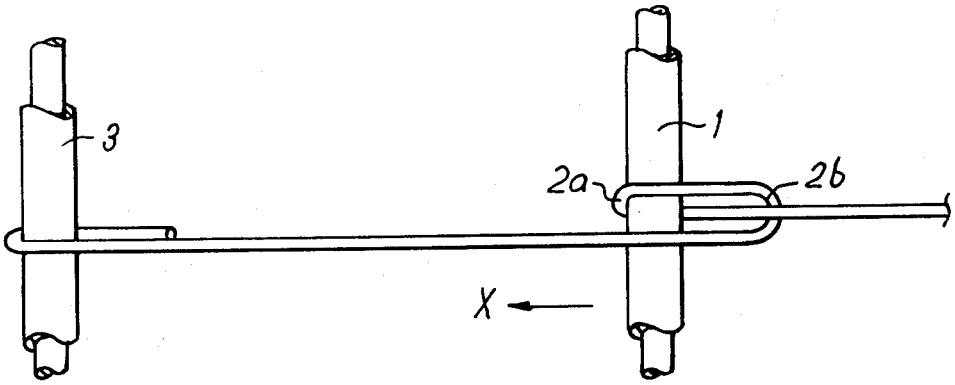
FIG. 6
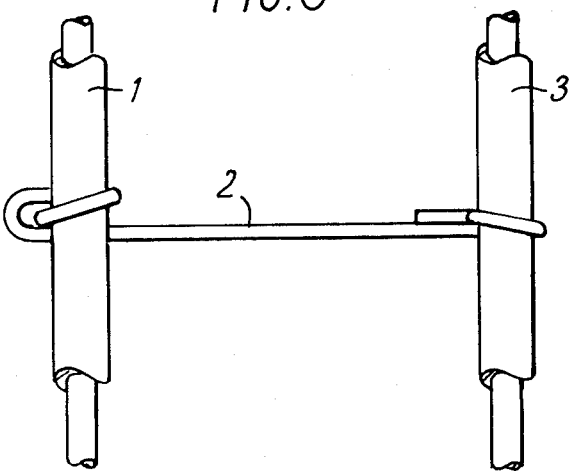
FIG. 7
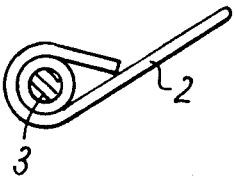

SPRING PANEL FOR SEAT CUSHION SUPPORT STRUCTURE

BACKGROUND OF THE INVENTION

This invention concerns improvements in and relating to seats, more especially for vehicles.

The invention is concerned with a sprung support structure for attachment to the frame of a vehicle seat in order to provide support for the cushioning and upholstery material of the seat. Such structures are well known, and generally comprise a pair of longitudinally extending side cords formed by paper-wrapped, or plastics-coated wires, and a plurality of transverse wires which extend between and are wrapped around said side cords. The frictional engagement of the transverse wires with the paper or plastics coating of the side cords maintains the transverse wires in an appropriate longitudinal spacing, and in addition, in order to maintain the spacing of the transverse wires at one or more points between the side cords, the transverse wires may be arranged to penetrate one or more further longitudinally extending cords formed of twisted paper, or extruded synthetic plastics material. Such structures form a skeleton for supporting the foamed synthetic plastics material which serves as the cushioning in the modern automobile seat, and may be supported relatively to the frame of the seat by engagement of the said side cords with compression springs located between the side cords and a supporting structure, or by means of tension springs engaging between the said side cords and laterally outwardly spaced frame members of the seat frame. Alternatively, the support structure may simply be embedded in a cushion of moulded synthetic plastics material which is supported in a seat-pan formed of sheet metal.

In order to meet the increasing requirements for automobile seats having a contoured construction, i.e., with a central, flat cushion surface bounded by one or more angled wings, providing lateral or frontal support, cushion structures as referred to above have been developed by extending the said transverse wires beyond the said side cords, at an acute angle to the central portions of said transverse wires, and interconnecting the ends of said transverse wires by means of further longitudinally extending edge wires which define the outer boundary of the seat cushion.

In accordance with one such known construction, as described in U.S.A. Pat. No. 3,639,002, the said transverse wires are wound helically about the said side cords, before being extended to form the side wings of the support structure. Such an arrangement has proved effective in use when supported from a seat frame by means of compression springs, or by being embedded in a foamed synthetic plastics cushion, as described above. However, when such an arrangement is suspended between lateral members of a seat frame by means of tension springs engaging the said side cords, which is a particularly preferred method of installing such a structure in a seat frame, the hitherto known structure has the disadvantage that the helically wound portions of said transverse wires which engage the side cords tend to become unwound as a result of the forces placed on said side cords by the tension springs. This disadvantage renders such a support structure unsuitable for use with this type of spring suspension, or at least requires that the transverse wires be formed of much heavier gauge wire than would otherwise be necessary.

SUMMARY OF THE INVENTION

It is accordingly an object of the present invention to provide an improved, contoured cushion support structure of the kind generally described above, in which the disadvantages referred to are overcome.

In accordance with the present invention there is provided a cushion support structure for incorporation in a seat, more especially a vehicle seat, comprising a pair of spaced longitudinally extending cord members, a plurality of spring metal wires extending transversely between said longitudinal cords and being connected to the latter by being looped around the same, said transverse wires being spaced apart from one another in the longitudinal direction of said cords, the said transverse wires further having outwardly extending portions which extend beyond at least one of said longitudinal cords, are arranged at an acute angle to the axes of the intermediate portions of said transverse wires between the said longitudinal cords, and are connected, at their ends, to a further, longitudinally extending, edge-cord, wherein the said transverse wires in addition to being looped around said longitudinally extending cords, are interlocked with themselves, to prevent unwinding of said wires under the influence of outward tension placed upon said longitudinally extending cords.

In one embodiment of the invention the arrangement is such that each of said transverse wires is engaged with at least one of said longitudinal cords by extending underneath one side of the side cord, being wound around the latter through an angle of at least about 210°, then being wound around itself through at least 180°, before extending over the said other side of said side cord at an acute angle to the said intermediate part of the transverse wire.

According to another embodiment of the invention each of said transverse wires is engaged with at least one of said longitudinal cords by extending over one side of the side cord, being wound around the latter through an angle of at least about 210°, then being angled to extend over itself in a direction substantially parallel to the said side cord, before again being angled to extend over the side cord at an acute angle to the said intermediate part of the transverse wire.

BRIEF DESCRIPTION OF THE DRAWINGS

FIG. 4 is an enlarged fragmentary view of FIG. 3, FIG. 5 is an enlarged fragmentary view of FIG. 1, FIG. 6 is an enlarged fragmentary view of FIG. 2, FIG. 7 is a detailed view corresponding to FIG. 4, and showing a modification to the arrangement of FIG. 4, and FIGS. 8–13 are views similar to FIGS. 1–6, and illustrate a further embodiment of the invention.

DETAILED DESCRIPTION OF THE PREFERRED EMBODIMENTS

Figure 1:
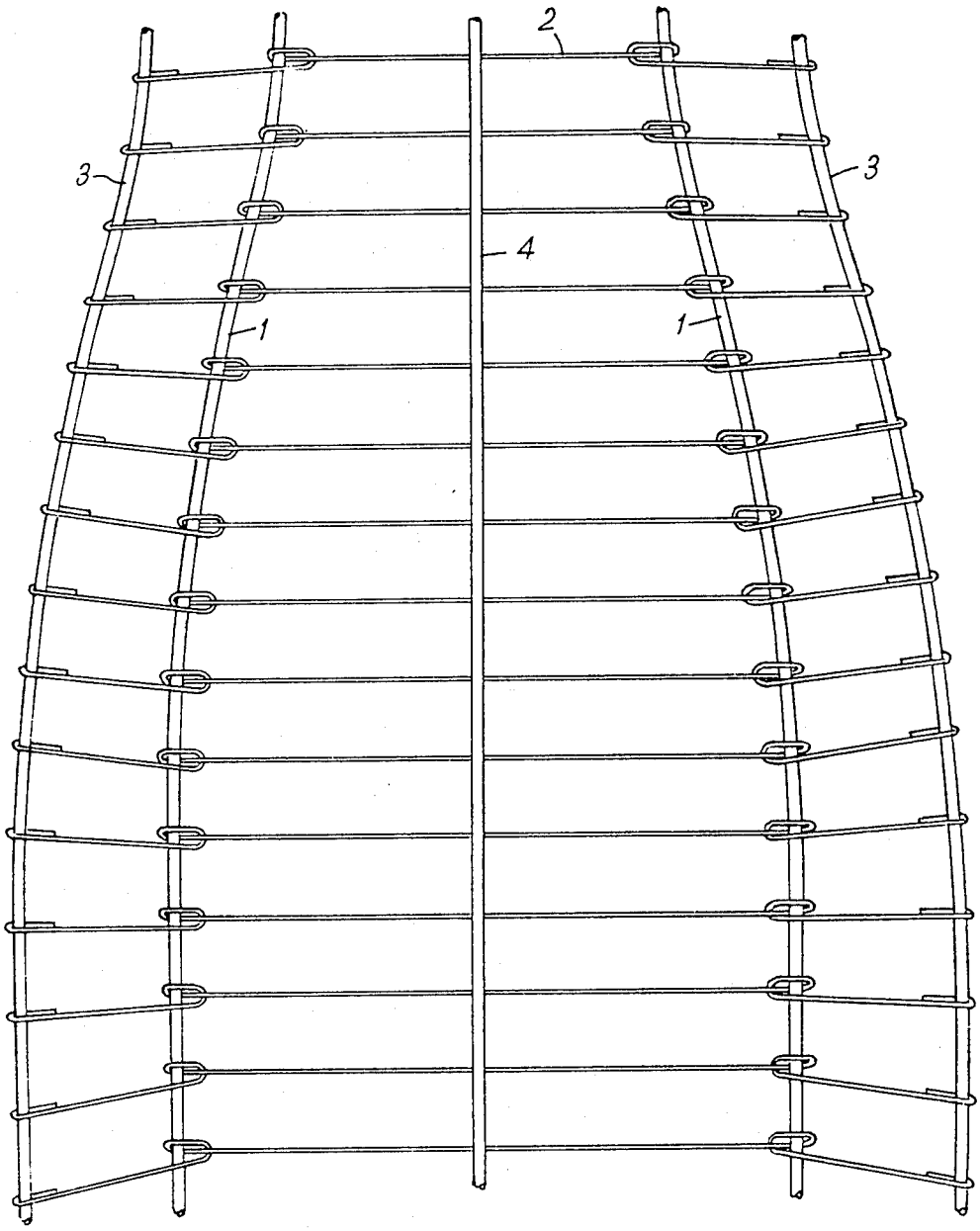
FIG. 1 is a front view of a cushion support structure for incorporation in the back-rest of an automobile seat.
Figure 3:
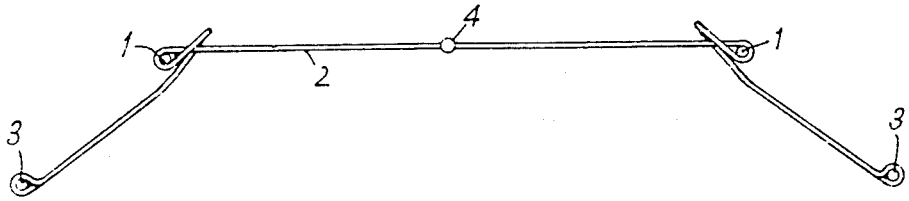
FIG. 3 is a plan view corresponding to FIG. 1.
Figure 2:
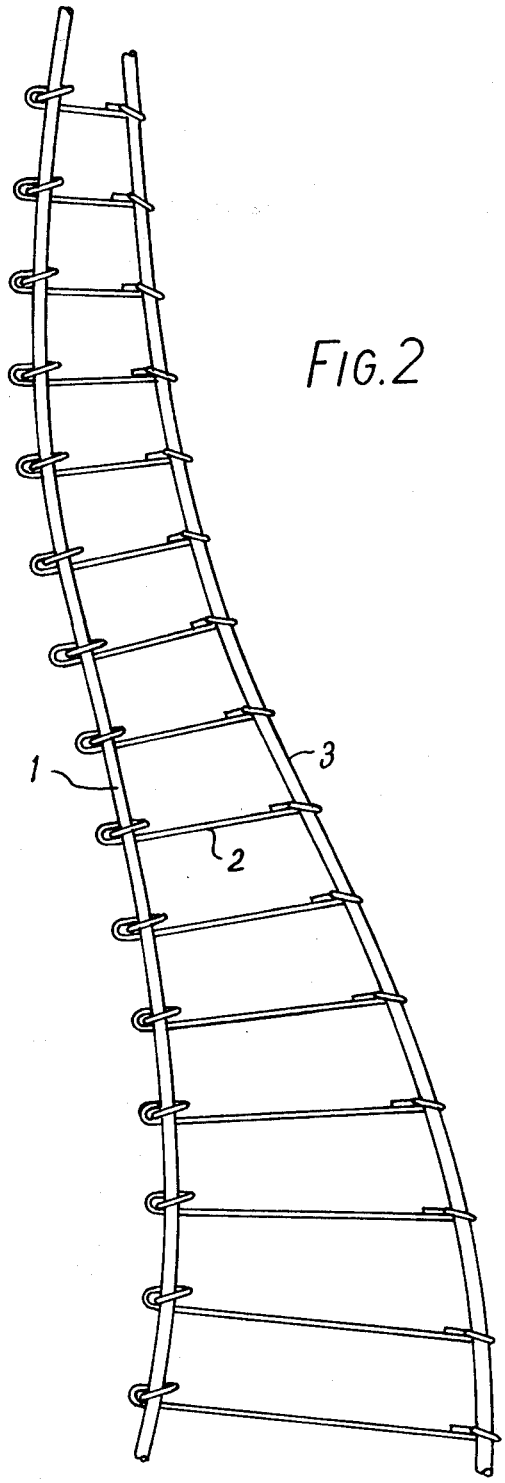
FIG. 2 is a side view corresponding to FIG. 1.

Referring to FIGS. 1–7 of the drawings, there is shown a cushion support structure comprising a pair of longitudinally extending side cords 1, a plurality of transversely extending spring wires 2, a pair of side edge cords 3, and a longitudinally extending central cord 4. The cords 1 preferably comprise paper-wrapped, or plastics coated wires of heavier gauge than the transverse spring wires 2, which are preferably formed of tempered spring wire such as piano wire. The side cords 3 are similar to the cords 1, whilst the central cord 4 is formed of twisted paper, or extruded synthetic plastics material, and is penetrated by the transverse wires 2. The transverse wires 2 embrace and firmly grip the paper or plastics covering of the cords 1 and 3, and are thus maintained at their appropriate longitudinal spacing by frictional engagement with the cords 1 and 3, as well as by penetration of the cord 4.

As shown more clearly in FIGS. 4 to 6, each transverse wire 2 is wound around the respective cord 1 to an angle greater than about 210°, as indicated at 2*a*, is then bent through 180° to form a U-shape as shown at 2*b*, before being extended into engagement with the outer side edge cords 3. The angle portion 2*b* is spaced from the intermediate portion of the transverse wire 2, in order to allow for flexing of the outwardly extending angled portion of the wire.

The cushion support structure as described above may be supported in a seat frame, not shown, of conventional construction, by engagement of tension springs between the longitudinal cords 1, and corresponding lateral members of the seat frame. It will be seen that by formation of the transverse wires 2 into an interlocking configuration in accordance with the invention, when corresponding outward tensional forces are placed upon the longitudinal cords 1 in the direction of the arrow X, any tendency for the portion 2*a* of the transverse wires 2 to become unwound under such tension is resisted by means of the portions 2*b* which interlock with the central part of the wires 2. Thus, the transverse wires 2 may be formed of smaller gauge than is the case with similar, known constructions of seat, in which the wires 2 are simply helically wound around the cords 1.

Figure 8:
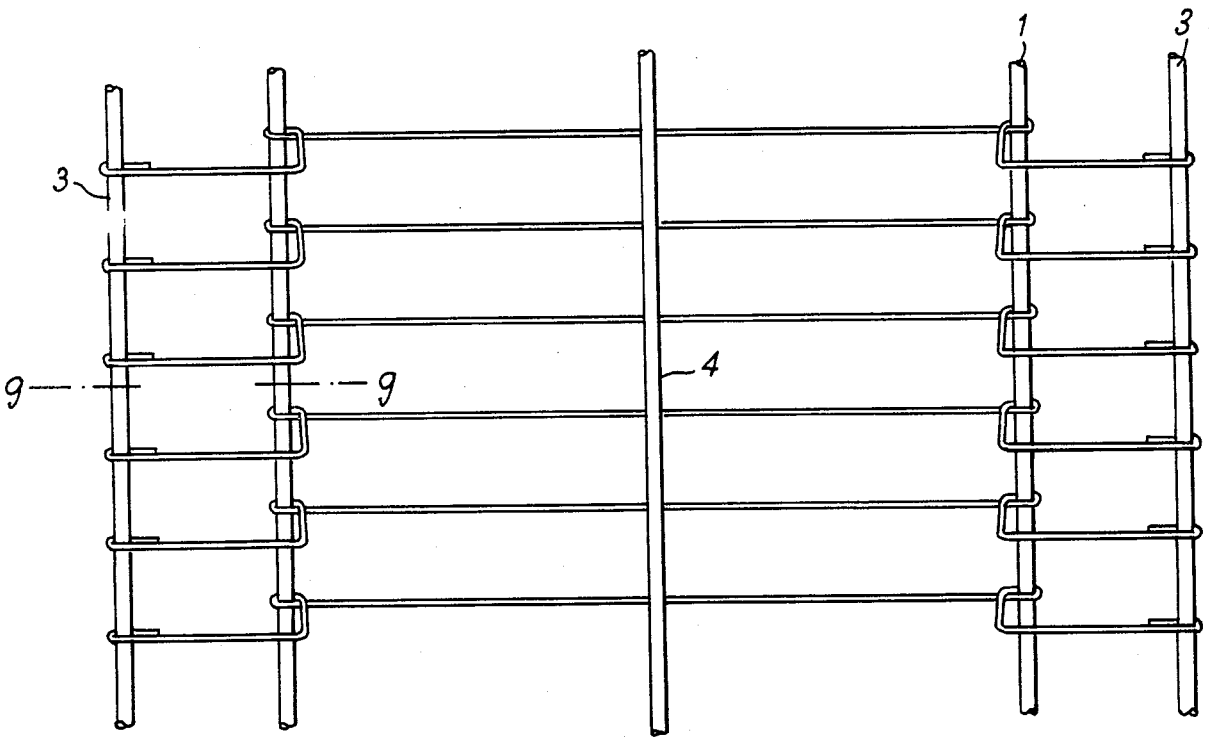
Figure 9:
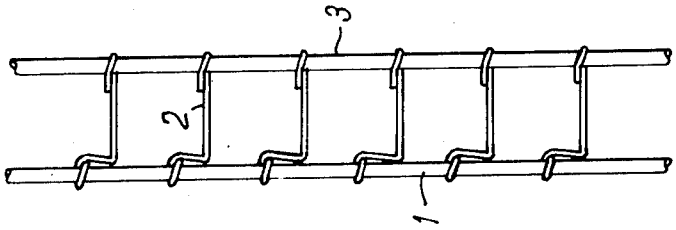
Figure 10:
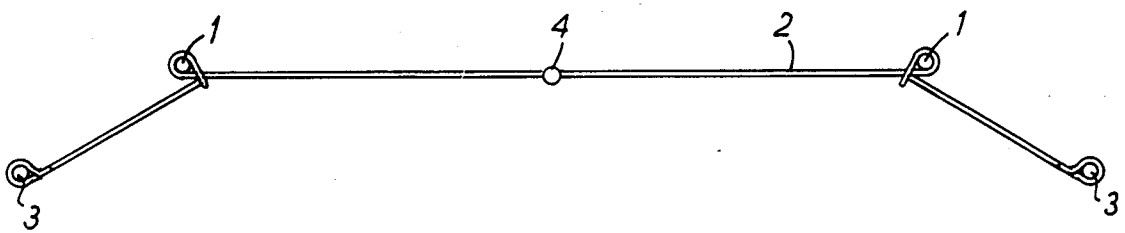
Figure 11:
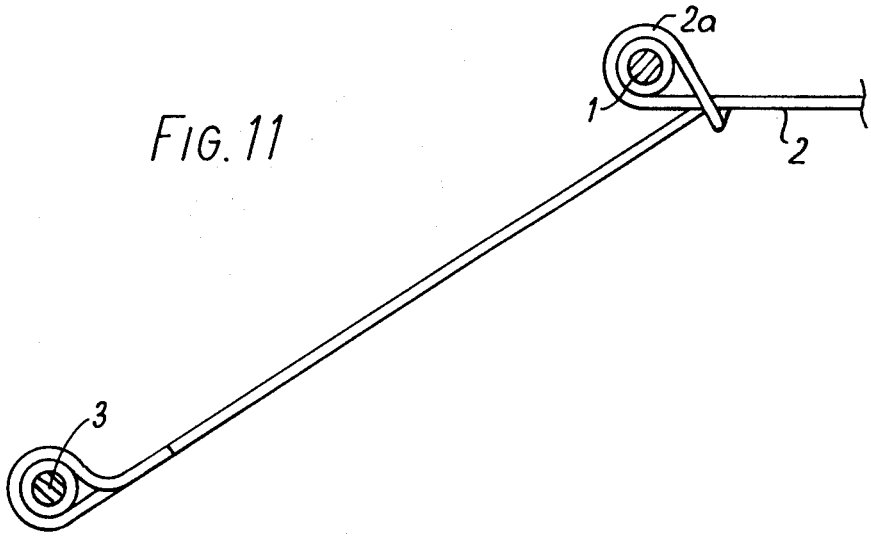
Figure 12:
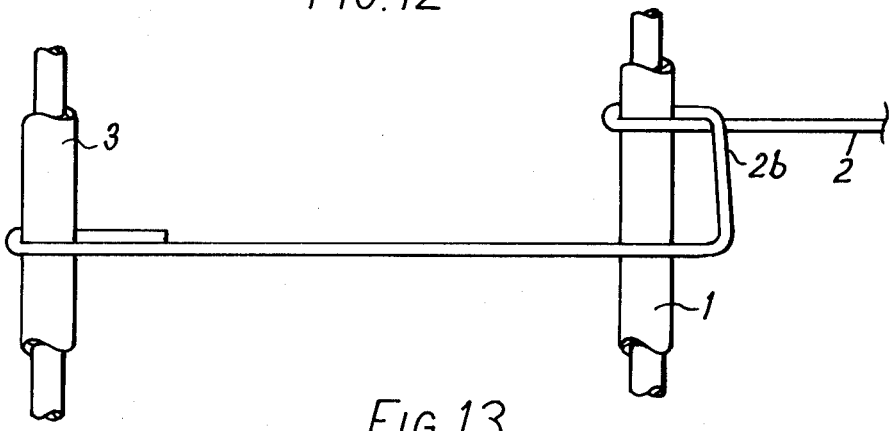
Figure 13:
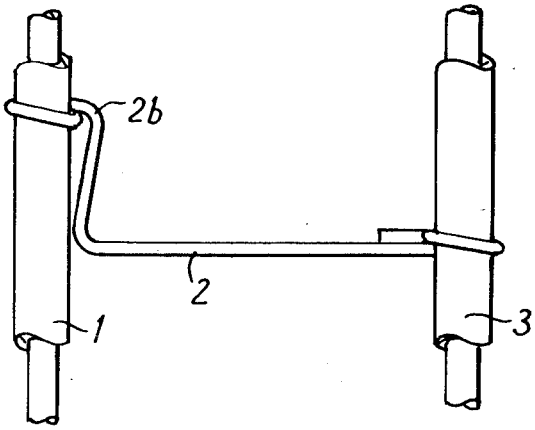

Referring to FIGS. 8–13 of the drawings, the same reference numerals are used as in FIGS. 1–7 of the drawings to indicate like parts, and detailed description thereof will not therefore be repeated. In the present case, however, the manner in which the transverse wires 2 are attached to the side cords 1 differs from that of the previously described embodiment. As can be seen more clearly in FIGS. 11–13, the transverse wires 2 extend over the top of the respective cord 1, and are wound around the same through an angle greater than about 210°, as indicated at 2*a*. The wires 2 are then bent at an angle of slightly greater than 90° in order to extend over themselves as shown at 2*b*, and after extending substantially parallel with the cord 1 for a short distance are again bent at 90° so that the portions extending between the cord 1 and the side edge cord 3 extend at an obtuse angle to the intermediate portion of the wire 2.

From a consideration of the configuration of the wire shown in the drawings it can be seen that as in the case of the embodiment of the invention illustrated in FIGS. 1–7 the part 2*b* of the transverse wire provide an interlocking configuration which will tend to prevent unwinding of the portion 2*a* of the wire when outward tension is placed upon the cord 1.

I claim:

1. A cushion support structure for incorporation in a seat, comprising two spaced longitudinally extending cord members, a plurality of spring metal wires extending transversely between said longitudinal cord members and connected to the latter, said transverse wires spaced apart from one another in the longitudinal direction of said cord members, said transverse wires extending outwardly beyond at least one said longitudinal cord member at an acute angle to the axis of the portions of said transverse wires intermediate said cord members, and at least one longitudinally extending edge cord interconnecting the free ends of said outwardly extending transverse wires, the said transverse wires having, between said intermediate portions and said outwardly extending portions, portions looped around said at least one cord member to connect with the latter, and portions extending across the said intermediate portions, in a direction substantially parallel to said at least one longitudinal cord member and adjacent said at least one longitudinal cord member whereby said looped portions are interlocked against unwinding under outward tension placed upon said at least one longitudinal cord member.

2. A structure according to claim 1, wherein each said transverse wire extends under said at least one longitudinal cord member, is looped around the latter through an angle of at least 210° to form said looped portion, is looped around itself through an angle of at least 180° to form the said substantially parallel portion and then extends over the said at least one longitudinal side cord, to form the interlocked connection.

3. A structure according to claim 1, wherein each said transverse wire extends over said at least one longitudinal cord member, is looped around the latter through an angle of at least 210° to form said looped portion is angled over itself at about 90° to form said substantially parallel portion, and is again angled to extend over said at least one longitudinal side cord.

* * * * *